US006006844A

United States Patent [19]

Van Puymbroeck et al.

[11] Patent Number: 6,006,844

[45] Date of Patent: Dec. 28, 1999

[54] METHOD AND APPARATUS FOR SIMULTANEOUS CORING AND FORMATION EVALUATION

[75] Inventors: Luc Van Puymbroeck, Houston; John W. Harrell; Michael H. Johnson, both of Spring; Pierre E. Collee, Kingwood, all of Tex.

[73] Assignee: Baker Hughes Incorporated, Houston, Tex.

[21] Appl. No.: 08/732,911

[22] Filed: Oct. 17, 1996

Related U.S. Application Data

[63] Continuation-in-part of application No. 08/311,118, Sep. 23, 1994, Pat. No. 5,568,838.

[51] Int. Cl.[6] ..... E21B 25/02; E21B 49/02

[52] U.S. Cl. ..... 175/50; 175/44; 175/58; 175/246; 175/257; 73/152.43

[58] Field of Search ..... 175/44, 40, 50, 175/58, 236, 239, 246, 257; 73/152.43, 152.03, 152.07

[56] References Cited

U.S. PATENT DOCUMENTS

| | | | |
|---|---|---|---|
| 2,489,566 | 11/1949 | Engle | 175/44 |
| 2,735,652 | 2/1956 | Brady | 175/44 |
| 2,820,610 | 1/1958 | Martinez et al. | 175/44 |
| 3,059,707 | 10/1962 | Frisby | 175/44 |
| 3,127,943 | 4/1964 | Mori . | |
| 3,481,412 | 12/1969 | Rowley . | |
| 3,548,958 | 12/1970 | Blackwell et al. . | |
| 4,601,354 | 7/1986 | Campbell et al. | 175/46 |
| 4,765,414 | 8/1988 | Moore | 175/44 |

(List continued on next page.)

FOREIGN PATENT DOCUMENTS

| | | | |
|---|---|---|---|
| 0 197 696 A2 | 10/1986 | European Pat. Off. . | |
| 2 188 352 | 9/1987 | United Kingdom . | |
| 2 220 961 | 1/1990 | United Kingdom . | |
| 2231357 | 11/1990 | United Kingdom | 175/40 |

OTHER PUBLICATIONS

Rowley et al., the article entitled "Oriented Cores in 1964, Sign of a Technological Renaissance in Diamond Coring", Apr. 1964.

Bonner, Steve, et al., "Resistivity While Drilling—Images from the String," Schlumberger Oilfield Review, Spring 1996, vol. 8, No. 1, pp. 1–19.

Anadrill IDEAL Drilling System brochure, pp. 1–9, undated.

Eastman Christensen Catalog, "Slimhole Coring," Special Applications, p. 18, undated.

"Gel Coring[SM] System Protects Core, Provides Enhanced Reservoir Data," Gel Coring[SM] System, Baker Hughes Inteq, Apr. 1994 (4 pages).

Sinor, L.A., et al., "Development of an Anti–Whirl Core Bit," SPE 24587, PP. 413–425, 1992.

*Primary Examiner*—Hoang Dang
*Attorney, Agent, or Firm*—Trask, Britt & Rossa

[57] ABSTRACT

A core barrel having an inner tube for coring and, alternately, a center plug assembly for closing the throat of the core bit at the bottom of the assembly for drilling in lieu of coring. The inner tube assembly and plug assembly are disposable and retrievable through the drill string on a wireline using an overshot. The core bit is of a stabilized, preferably anti-whirl, design and may be a low-invasion core bit used in cooperation with a low-invasion coring shoe. A logging tool and data transmission assembly may be incorporated in the plug assembly for logging while drilling. Alternatively, sensors for logging borehole parameters and a data transmission assembly may be incorporated in the inner tube assembly, in the wall of the core barrel, above the core barrel, or in a combination of such locations. A significant feature of the apparatus and its operation is the ability to concurrently sense one or more characteristics of the formation surrounding the core barrel in combination with the sensing of one or more such parameters of the core being cut as it proceeds into the inner tube assembly.

31 Claims, 9 Drawing Sheets

U.S. PATENT DOCUMENTS

| | | |
|---|---|---|
| 4,815,342 | 3/1989 | Brett et al. . |
| 4,955,438 | 9/1990 | Juergens et al. . |
| 4,981,183 | 1/1991 | Tibbitts . |
| 4,982,802 | 1/1991 | Warren et al. . |
| 5,009,273 | 4/1991 | Grabinski . |
| 5,010,765 | 4/1991 | Duckworth et al. . |
| 5,010,789 | 4/1991 | Brett et al. . |
| 5,020,612 | 6/1991 | Williams . |
| 5,029,653 | 7/1991 | Jürgens et al. . |
| 5,038,873 | 8/1991 | Jürgens . |
| 5,042,596 | 8/1991 | Brett et al. . |
| 5,090,492 | 2/1992 | Keith . |
| 5,099,934 | 3/1992 | Barr . |
| 5,103,921 | 4/1992 | Zeer et al. . |
| 5,109,935 | 5/1992 | Hawke . |
| 5,111,892 | 5/1992 | Sinor et al. . |
| 5,119,892 | 6/1992 | Clegg et al. . |
| 5,131,478 | 7/1992 | Brett et al. . |
| 5,165,494 | 11/1992 | Barr . |
| 5,178,222 | 1/1993 | Jones et al. . |
| 5,253,720 | 10/1993 | Radford et al. . |
| 5,322,135 | 6/1994 | Travis . |
| 5,339,915 | 8/1994 | Laporte et al. . |
| 5,351,765 | 10/1994 | Ormsby . |
| 5,448,227 | 9/1995 | Orban et al. . |
| 5,568,838 | 10/1996 | Struthers et al. . |

METHOD AND APPARATUS FOR SIMULTANEOUS CORING AND FORMATION EVALUATION

This application is a continuation-in-part of U.S. patent application Ser. No. 311,118, filed Sep. 23, 1994, now U.S. Pat. No. 5,568,838.

BACKGROUND OF THE INVENTION

1. Field of the Invention

The present invention generally relates to wireline coring of subterranean formations and, more specifically, to a combination coring and drilling system offering interchangeable placement and retrieval of coring inner tube assemblies and drilling plug assemblies for drilling ahead, the latter also being optionally provided with logging capabilities for evaluation of borehole parameters and, specifically, the capability to concurrently log a formation being cored as well as the core sample being cut from the formation.

2. State of the Art

Wireline coring has been known for many years. The basic concept of wireline coring involves the use of a core barrel including an outer barrel assembly disposed at the end of a drill string and having a core bit or crown at the bottom thereof. An inner tube assembly for receiving a core cut by the core bit is releasably latched into the outer barrel assembly. This arrangement permits placement of the inner tube assembly in the outer barrel assembly by wireline, gravity, or hydraulic flow, and retrieval thereof from the outer barrel assembly via wireline. Examples of such prior art wireline coring systems are disclosed in U.S. Pat. Nos. 3,127,943 and 5,020,612, incorporated herein for all purposes by this reference.

One problem with many such prior art systems is the necessity of using a special drill string having an enlarged diameter to accommodate running and retrieval of an inner tube assembly used to cut relatively large cores in excess of two inches in diameter.

While coring systems cutting small or "slim-hole" cores of 1¾" or less in diameter are known, it will be appreciated that such cores are extremely fragile and conventional coring systems are limited in the length that such cores can be reasonably cut without fracturing. This limitation appears to be primarily due to instability of the entire core barrel initiated by lateral and vertical bit movement in the borehole, which produces vibration. A major phenomenon resulting from such bit movement and vibration is so-called bit "whirl", although vibration without whirl is still detrimental. The phenomenon of bit "whirl" is exhibited in bits having unbalanced cutter side forces, which forces cause the bit to rotate or "whirl" in the borehole about a center point offset from the geometric center of the bit in such a manner that the bit tends to whirl backwards about the borehole. The whirl phenomenon has been observed to be aggravated by the presence of gage cutters or trimmers at certain locations on the outer gage of the bit, such cutters also generating frictional forces during drilling. Whirl is a dynamic and self-sustaining phenomenon and, in many instances, is highly destructive to the drill bit cutters. The whirl phenomenon also causes spiraling of the borehole during drilling which results, in core bits, in a non-cylindrical, spiraled core which is more susceptible to fracture and jamming in the core barrel inner tube.

Given the relatively small clearances between the core and the pilot shoe, core catcher and inner tube components of the inner barrel, slight lateral and vertical movements of the core barrel easily result in fracture of small-diameter cores with attendant core jamming and degradation of the core sample. As a result, small diameter core barrels have been traditionally limited in length due to the short (for example, ten to thirteen foot) core samples which could be cut without experiencing the aforementioned core fracture, jamming and degradation. Attempts have been made to cut longer cores, as long as twenty-six feet, but the apparatus employed has never been deemed successful due, again, to the aforementioned problems.

It has been recognized that certain recent improvements in bit design, including but not limited to the so-called "anti-whirl" polycrystalline diamond compact (PDC) cutter bits initiated by Amoco and improved by the assignee of the present invention, could be applied to core bits to enhance the reliability of a coring operation and the quality of the cores. Patents disclosing anti-whirl bits include, without limitation, U.S. Pat. Nos. 4,982,802; 5,010,789; 5,042,596; 5,099,934; 5,109,935; 5,111,892; 5,119,892; 5,131,478; 5,165,494; and 5,178,222, the disclosures of which are incorporated herein by this reference. SPE (Society of Petroleum Engineers) Paper No. 24587 by L. A. Sinor et al of Amoco Production Co., entitled "Development of an Anti-Whirl Core Bit", discusses improvements and potential improvements in coring capability thought to be offered through the use of anti-whirl core bits.

Other approaches to bit stabilization have been taken by Amoco as well as others. One approach is to attempt to perfectly balance a bit, as disclosed in U.S. Pat. No. 4,815,342, the disclosure of which is incorporated herein by reference. Another approach is to mechanically "lock" the projections on the bit face into circular grooves cut by the cutters on the face, as disclosed in U.S. Pat. No. 5,090,492, the disclosure of which is incorporated herein by reference.

All of the foregoing developments in bit stabilization have been focused on discrete elements of the drilling operation, either drilling a full-gage wellbore or in coring.

Some years ago, Eastman Christensen Company, a predecessor to the assignee of the present invention, developed a combination drilling and coring system having a "Drill-Core System" option, which allowed for alternate coring and drilling operations without tripping the drill string. In the Drill-Core System, both the inner barrel assembly for coring and a substitute center plug assembly with a crowsfoot and cutters for converting the core bit to a drill bit were deployable and retrievable via wireline. The Drill-Core System employed natural diamond core bits and was only marginally successful for several reasons. First, the maximum core length which could be cut at one time was only thirteen feet, providing an extremely short interval for analysis without multiple trips of the inner tube assembly, and requiring combination with odd-length tubulars to drill the kelly down to the rotary table like a pipe joint. In addition, the advent of more accurate electric well logs and analysis techniques for logging data reduced the demand for core analysis. Finally, the industry was not accepting of the relatively small diameter cores (2" ) taken by the system, which was required in order to deploy and retrieve the inner barrel assembly and center plug assembly through standard tubular goods.

In recent years, however, the development and industry acceptance of punch-and rotary-type sidewall coring techniques which result in 1" diameter cores from the side of the borehole being drilled, as well as the increased use of slim-hole drilling for exploratory wells has eliminated the prior hesitancy to accept and rely upon small-diameter cores.

These changes in industry practices have resulted in a renewed interest in coring, but to date, state of the art coring systems have not offered an acceptable slim-hole coring and drilling system which can cut pristine, undamaged cores of a desirable length (for example, thirty feet), substantially avoid core jamming, and also provide a capability for drilling ahead between intervals to be cored without tripping the drill string. Moreover, no state of the art coring system offers performance capabilities and operating characteristics similar to those of PDC drill bits.

Another disadvantage of state of the art coring approaches is the tendency to treat taking (cutting) of the core and evaluation of borehole parameters as separate, only peripherally related operations instead of two interrelated segments of the overall formation evaluation process. While U.S. Pat. No. 4,955,438, assigned to the assignee of the present invention and incorporated herein for all purposes by this reference, discloses taking "measured values" of the borehole characteristics during a coring operation and retrieving such data from the coring apparatus physically, by wireline or by mud-pulse telemetry, the inventors herein are not aware of the existence of any such system suitable for use in oil and gas exploratory wells. Further, while it would be desirable to log certain characteristics of a core while it is being cut and concurrently with logging directional parameters as well as characteristics of the formation exterior to the coring apparatus, no coring system with such capabilities is known to exist.

SUMMARY OF THE INVENTION

The present invention offers the capability of alternately coring and drilling without tripping the drill string and taking extended-length small diameter cores.

The core barrel of the invention includes an outer barrel assembly having a PDC core bit disposed at the lower end thereof and a bit end bearing assembly immediately above the core bit within the core barrel for alternately receiving the end of an inner tube assembly or a center plug assembly. A latch coupling is located on the upper interior of the outer barrel assembly. The inner tube assembly includes an overshot coupling member at the upper end, a latch assembly therebelow for engaging the outer barrel latch coupling, and a bearing assembly below the latch assembly for permitting rotation between the outer barrel assembly and the inner tube. The lower end of the inner tube assembly, which engages the bit bearing assembly, includes a conventional core catcher.

The PDC core bit employed in the invention is preferably of an anti-whirl design, although other stabilized bit designs such as discussed above may also be suitable. Employing an anti-whirl core bit in the invention results in the demonstrated capability to cut and pull at least thirty foot cores of high quality and greatly increased recovery rate. Moreover, the use of a PDC core bit with optional center plug affords a rate of penetration (ROP) similar to that of PDC drill bits, and weight-on-bit (WOB), rotational speed and hydraulic flow rates similar to that of PDC drill bits. Thus, large quantities of high quality cores may be obtained cost-effectively and the overall ROP during the drilling operation is not substantially reduced in comparison to drilling without coring, the operator benefitting from time and cost savings as well as from the information available from the high quality cores.

The use of the bit end bearing assembly results in precise alignment of the inner tube to receive the core being cut as well as a seating arrangement for the lower end of the center plug assembly which contains a plurality of PDC cutters and fluid outlets for drilling fluid.

An optional but significant feature of the present invention is the disposition of a suitable logging tool, such as a gamma ray or directional logging tool, in the center plug assembly to permit the conduct of a logging-while-drilling operation. Data may be stored in the logging tool while drilling and periodically retrieved by wireline transmission or when the center plug assembly is retrieved to the surface, or a mud-pulse or other suitable data transmission system may be incorporated as part of the center plug assembly to permit real-time transmission of data. One or more sensing capabilities may be included in the tool, such capabilities including, without limitation, pressure and temperature measurement in addition to the others mentioned above. It is noteworthy that the logging tool sensors and, in particular, sensors for detection of formation characteristics, may be disposed immediately adjacent the lower or leading end of the center plug assembly, literally in the throat of the core bit, for extremely close proximity to the bit face and thus to the formation being drilled.

It is also contemplated that sensors for measuring direction parameters as well as the borehole parameters noted above and further including others such as (by way of example only) formation resistivity and nuclear magnetic resonance (NMR), as well as a power supply, data processing and memory, and downhole data transmission or telemetry capability, may be incorporated in one or more of a coring inner tube assembly, in the wall of the core barrel between the exterior and bore thereof, or above the core barrel in a separate sub or housing having an axial bore therethrough aligned with the bore of the core barrel. Sensors for measuring drilling parameters such as (again by way of example only) torque, rotational speed, weight on bit, vibration and borehole pressure may also be incorporated in one or more components of the apparatus, preferably close to the bit such as in the wall of the core barrel.

Another aspect of the invention involves simultaneous, or at least concurrent, logging of borehole parameters of the formation exterior to the core barrel while logging the same or a different borehole parameter of the core being cut while it is entering the core inner tube assembly. For example, gamma ray, resistivity, density, porosity, sonic and/or NMR logs may be taken. It is advantageous to take such logs for comparison purposes with regard to the characteristics demonstrated by the external formation as opposed to those exhibited by the core under the more controlled environment of the core barrel interior and at extremely close range. Moreover, it is desirable to conduct such core logs immediately after core passage through the throat of the core bit when the core is in its most pristine state and the least likely to have become excessively contaminated by drilling mud or to have lost its physical integrity. Further, it is contemplated that the orientation of the core will be determined, both in an absolute sense and with respect to the surrounding formation from which it is cut, using the directional instrumentation of the apparatus.

It is further contemplated that a short-hop wireless telemetry system may be employed to transmit data over a short distance from a location in the core barrel wall to the inner tube assembly, or vice versa, for subsequent re-transmission by a long-distance telemetry system located in the other component of the apparatus, or from either of these locations to a long-distance telemetry module located a short distance above the core barrel in the borehole. Data may be re-transmitted by mud-pulse, acoustic, or electromagnetic telemetry, or by wireline extending to the surface. Further, data may be stored in electronic memory located in the inner tube assembly or the aforementioned center plug assembly and physically retrieved therewith to the surface rather than being transmitted in essentially real time. Of course, data is preferably stored in an inner tube assembly, center plug assembly, core barrel or separate housing associated with the coring apparatus, even if transmitted to the surface in real time, to prevent loss of data due to poor transmission or transmitter failure.

Yet another aspect of the present invention resides in a method of drilling while taking directional, formation and optionally drilling parameter data before a coring operation is undertaken, in order to locate a zone or stratum of potential interest, such as a hydrocarbon-producing zone, before the inner tube assembly is run to commence coring. Similarly, it is contemplated that taking such data during the coring operation will permit the operator to identify when coring should be ceased, and without coring of rock substantially beyond a zone of potential interest. In practicing this aspect of the invention, it would, of course, be desirable to communicate the data being taken to the surface on a real-time basis, particularly when drilling into a potential producing zone. When coring, it may be sufficient to retrieve data for each interval cored at the time the inner tube assembly with contained core sample is retrieved to the surface, but it would obviously be preferable to locate the termination point of the zone of interest as precisely as possible, indicating that real-time data transmission may also be preferable in that situation.

DETAILED DESCRIPTION OF THE PREFERRED EMBODIMENTS

Figure 1:
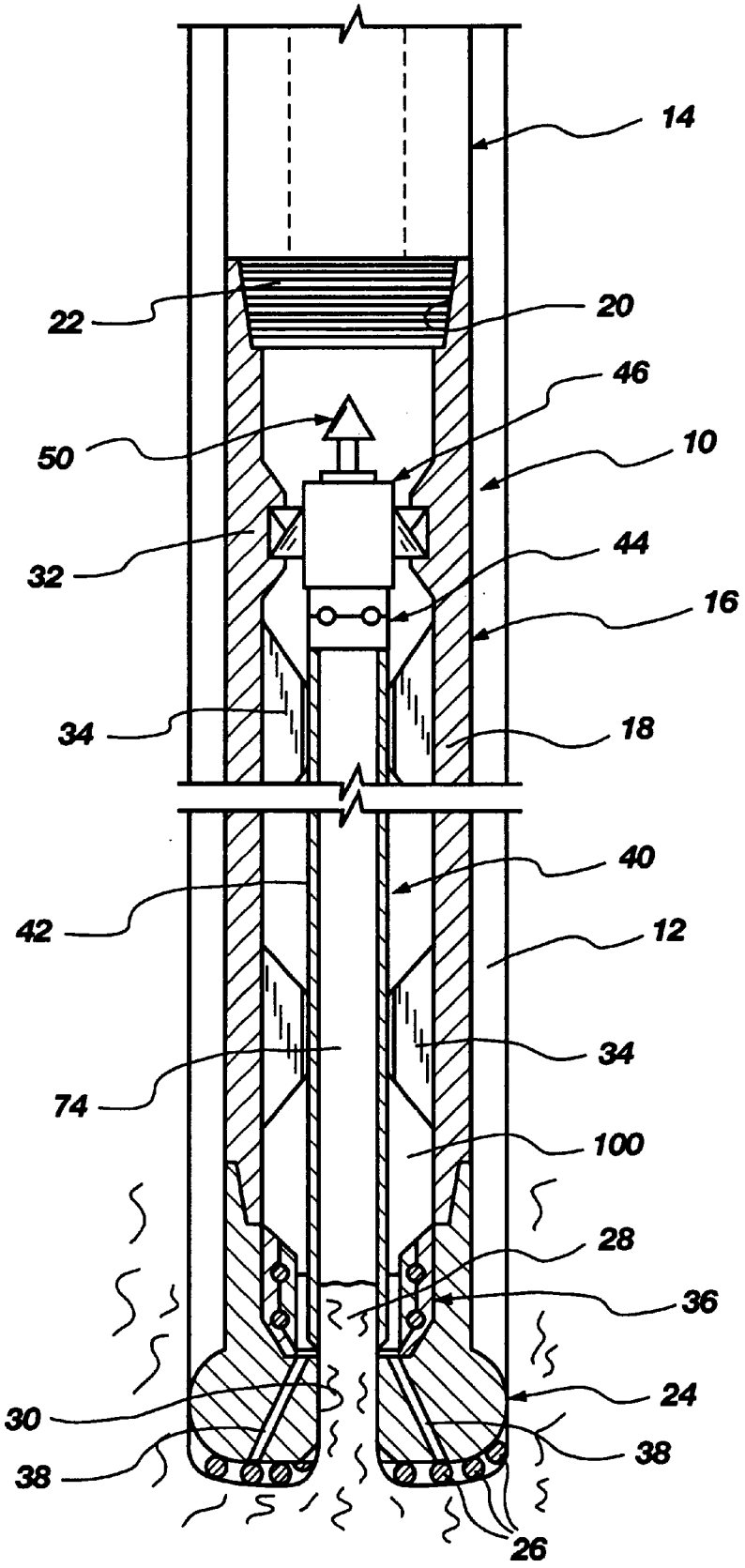
FIG. 1 is a schematic sectional side elevation of the core barrel of the present invention.

Referring now to FIG. 1 of the drawings, core barrel 10 of the present invention is depicted suspended in borehole 12 from drill collar 14 at the bottom of a drill string extending to the surface.

Core barrel 10 includes outer barrel assembly 16 having a tubular outer barrel 18. At the top of outer barrel 18 is a threaded box connection 20 for securing core barrel 10 to the threaded pin connection 22 of drill collar 14. Secured to the bottom of barrel 18 is a PDC core bit 24 of an anti-whirl or other stabilized design, as described previously. PDC cutters 26 on core bit 24 cut the formation as the drill string is rotated, and also cut a core 28 from the formation being drilled, the core 28 extending upwardly into the throat 30 of core bit 24 as the bit drills ahead into the formation. If desired, the core bit 24 may be of the low-invasion type, as disclosed and claimed in U.S. Pat. No. 4,981,183, assigned to the assignee of the present invention and incorporated herein by this reference. On the interior of barrel 18 is a latch coupling 32, below which is a plurality of axially-spaced groups of bearing ribs 34, the rib groups extending circumferentially around the interior of barrel 18. Within the interior of core bit 24 is a bit end rotational bearing assembly 36. Fluid passages 38 extend from the bit interior to the bit face.

Inner tube assembly 40 is shown disposed within core barrel 10 as it would be during a coring operation. Inner tube assembly 40 includes an inner tube 42 at the lower end thereof, which is received within bit end rotational bearing assembly 36. Inner tube 42 extends upwardly within outer barrel 18 through the groups of bearing ribs 34, which provide support against sagging and flexing of inner tube 42. At the top of inner tube 42 is inner tube bearing assembly 44, which permits the upper and lower portions of inner tube assembly 40 to rotate with respect to one another and, thus, in combination with bit end bearing assembly 36, allows outer barrel assembly 16 to rotate while inner tube assembly 40 remains stationary. Above bearing assembly 44, latch assembly 46 releasably engages latch coupling 32 on the interior of outer barrel 18. At the top of inner tube assembly 40, an overshot coupling 50 is located for selective engagement and release of the inner tube assembly 40 by a wireline overshot.

Figure 2:
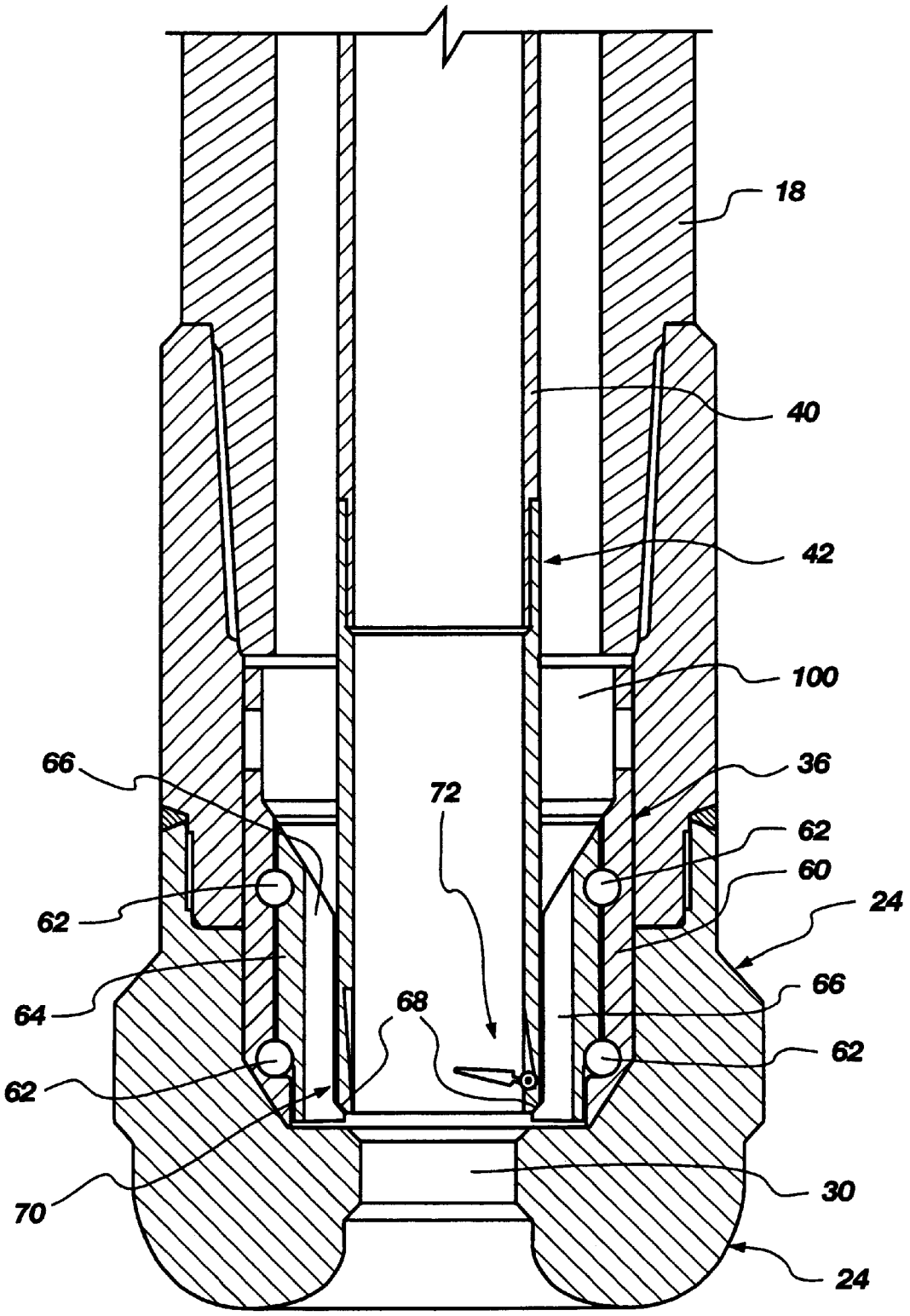
FIG. 2 is an enlarged side sectional elevation of the lower end of the core barrel of the invention with the inner tube assembly in place for coring.
Figure 3:
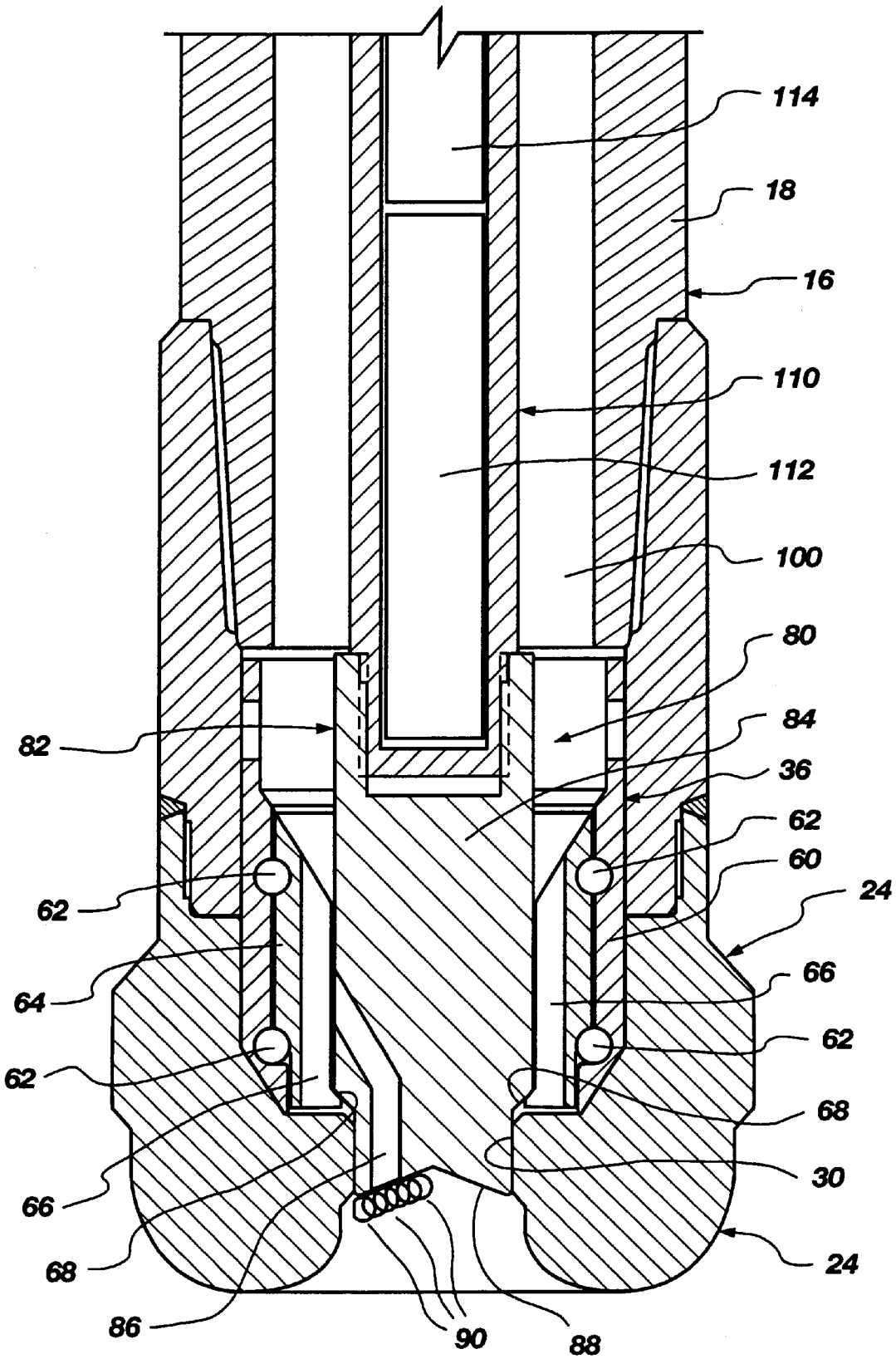
FIG. 3 is an enlarged side sectional elevation of the lower end of the core barrel of the invention with the center plug assembly in place for drilling.

Referring now to FIGS. 2 and 3 of the drawings, components which have been previously identified with respect to FIG. 1 will be designated by the same reference numerals to avoid confusion.

As shown in FIG. 2, bit end rotational bearing assembly 36 includes an outer housing 60, bearings 62, and an inner housing 64 which freely rotates with respect to outer housing 60 due to bearing 62. Ribs 66 having beveled shoulders 68 at their lower ends extend radially inwardly from inner housing 64, ribs 66 and shoulders 68 laterally and axially supporting the lower end of inner tube assembly 40 thereon. The space between ribs 66 permits drilling fluid to flow into throat 30 of core bit 24 and around the core 28 during coring. If this flow is not desired, a low-invasion core bit and cooperating shoe design of the type disclosed in the above-referenced '183 patent and illustrated in FIG. 5 of the drawings may be employed to minimize drilling fluid contact with the core. At the lower end of inner tube 42, either a wedge-type core catcher 70 as shown on the left-hand side of the drawing or a basket-type core catcher 72 as shown on the right-hand side of the drawing (both as known in the art) may be employed. PDC cutters 26 have been omitted from FIG. 2, but as shown in FIG. 1 they are disposed on core bit 24 so as to cut a core sized to move upwardly in throat 30 of core bit 24 and into the bore 74 of inner tube 42.

Referring now to FIG. 3 of the drawings, in lieu of inner tube assembly 40, center plug assembly 80 is shown disposed in outer barrel assembly 16. Center plug assembly 80 includes at the upper end thereof a latch assembly (not shown) similar to that of inner tube assembly 40, to engage the latch coupling 32 of outer barrel 18, as well as an overshot coupling 50 for placement and retrieval of the center plug assembly 80. No rotational bearing assembly is included in plug assembly 80, as rotation thereof with respect to outer barrel assembly 16 is not required or desired. Bit plug 82 is disposed at the bottom of plug assembly 80, and is supported by bit end bearing assembly 36 in the same manner as inner tube assembly 40. Bit plug 82 includes a plug body 84 having passages 86 therethrough for conducting drilling fluid to plug face 88 where PDC cutters 90 are located. Plug body 84 is sized to be received and supported laterally and axially by ribs 66 and shoulders 68 of inner housing 64 of bit end rotational bearing assembly 36. The spaces between ribs 66 permit drilling fluid to flow into passages 86, as shown.

When it is desired to core with the apparatus of the present invention, the inner tube assembly 40 is run into the drill string on a wireline and latched into outer barrel assembly 16. Drilling fluid is then circulated down the drill string and into the annulus 100 between the inner tube assembly 40 and outer barrel assembly 16, where it exits from the face of core bit 24 through conventional fluid passages and nozzles (not shown) to clean and cool the cutters and clean the bit face as the string is rotated and the formation and core are cut. When the maximum core length is reached, the inner tube assembly is pulled from the borehole via a wireline having an overshot at the end of it to engage coupling 50, and another inner tube assembly tripped into the drill string if further coring is desired.

If it is desired to drill instead of core, center plug assembly 80 is run into the borehole on wireline via an overshot which engages a coupling 50 at the top of the assembly. The assembly 80 then latches into the outer barrel 18, after which drilling fluid is pumped down the drill string into the annulus 100 between the plug assembly 80 and the outer barrel 18 and through passages 86 in plug body 84 to plug face 88 to cool and clean PDC cutters 90 and remove formation debris as the core barrel 10 is rotated and drilling proceeds.

If desired, plug assembly 80 may be provided with a pressure barrel or housing 110 within which resides a logging tool 112 such as a gamma ray tool or a directional tool for sensing the path of the borehole, for the conduct of logging while drilling. Also if desired, a data transmission assembly 114 may be disposed in pressure housing 110, the former comprising an electronic transmission assembly or a mud-pulse type assembly (in which case part of it would naturally be external to pressure housing 110) for real-time transmission of logging data to the surface via wireline or mud-pulse. Alternatively, data might be retrieved periodically by wireline, or when assembly 80 is pulled from the hole.

It is also contemplated that pressure and temperature sensors may be carried in pressure housing 110. The former are particularly desirable to measure dynamic pressure loss and thus flow rate to ascertain the flow rates suitable for coring when the center plug assembly 80 is replaced with inner tube assembly 40. By calculating or measuring hydrostatic pressure in the borehole annulus and measuring total pressure near the bit from Pressure housing 110, the dynamic pressure loss and thus flow rates can be ascertained so as to reduce or preferably eliminate core erosion and wash out.

Temperature measurement is particularly desirable and useful if a gel coring operation is conducted, with non-invasive gel for encapsulation of the core sample being pre-placed within inner tube 42 before running into the drill string. The temperature-sensitive nature of such gels and their ability to increase viscosity and even substantially solidify over a relatively narrow temperature range drop renders the ability to measure core barrel-depth temperature an extremely desirable capability, so as to permit formulation or selection of a gel which will viscosify at the desired depth and not prematurely. A more complete explanation of the formulation and use of non-invasive gels for core sample encapsulation is contained in co-pending U.S. patent application Ser. No. 08/051,093, filed Apr. 21, 1993, now U.S. Pat. No. 5,360,074 and assigned to the assignee of the present invention. The disclosure of the '074 patent is incorporated herein by this reference.

Figure 4:
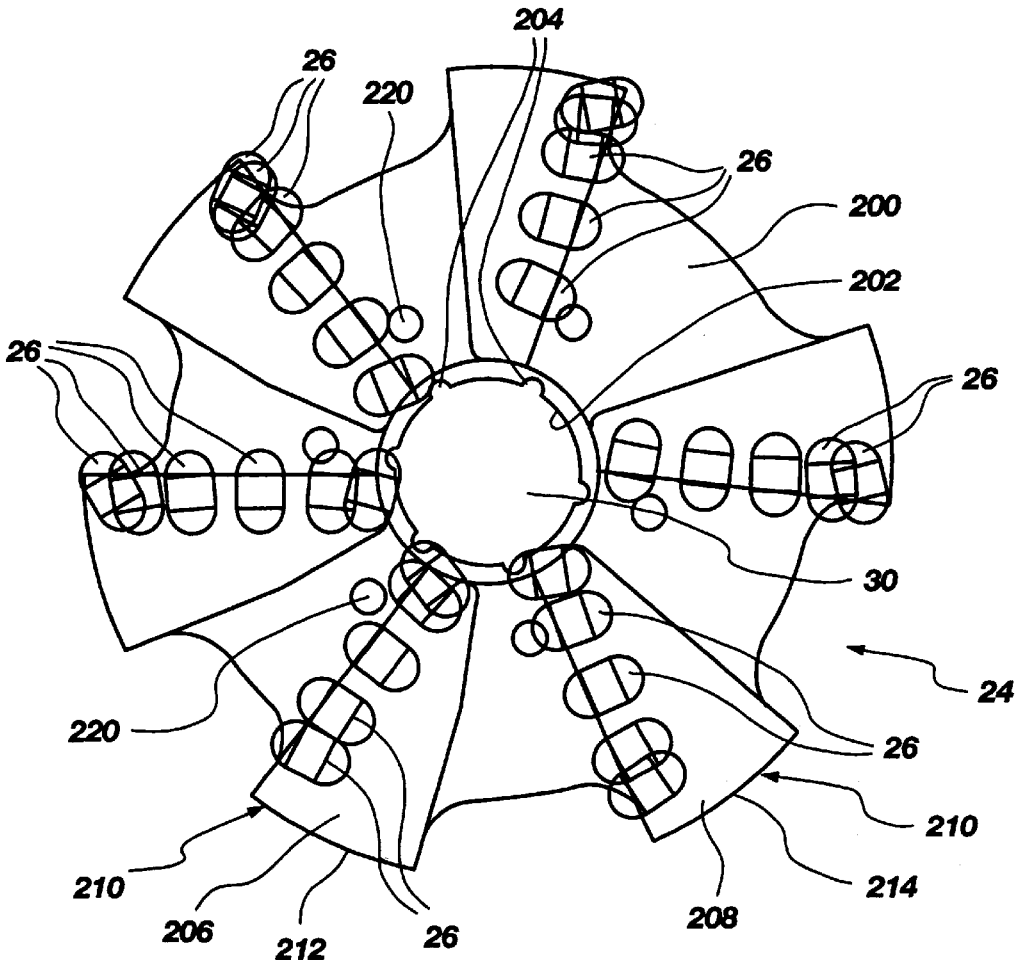
FIG. 4 is a schematic elevation showing cutter placement and looking downward through the bit face of an anti-whirl core bit suitable for use with the present invention.

Referring now to FIG. 4 of the drawings, exemplary anti-whirl core bit 24 is illustrated, looking downward through the bit face 200 as it would be oriented in the borehole. Placements of PDC cutters 26 are schematically shown on bit face 200, certain cutters 26 extending radially inwardly from inner gage 202 defining throat 30 of core bit 24, whereby a core may be cut of less diameter than that of throat 30. Channels 204 are placed about the inner gage 202 to permit drilling fluid flow, if desired, past the exterior of the core. Other fluid passages 220 extend through bit face 200. While anti-whirl bits are now well known in the art, it should be noted that blades 206 and 208 of core bit 24 are devoid of cutters at outer gage 210, and that gage pads 212 and 214 on blades 206 and 208 are used as bearing surfaces for core bit 24 to ride against the wall of the borehole. Selected size, placement and orientation of cutters 26 on bit face 200 results in a cumulative directed side or lateral force vector oriented in a direction perpendicular to the bit axis and between blades 206 and 208, causing gage pads 212 and 214 to ride substantially constantly against the borehole wall and eliminating vibration and the tendency toward bit whirl.

Figure 5:
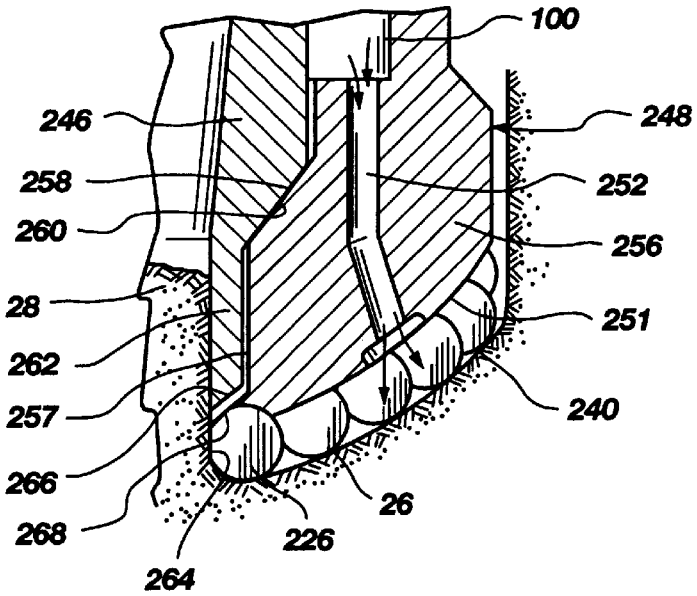
FIG. 5 is an enlarged side sectional vertical elevation of an exemplary low-invasion core bit inner gage cutter and cooperating coring shoe arrangement suitable for use with the present invention.

Referring now to FIG. 5 of the drawings, a low-invasion inner gage cutter arrangement on low-invasion core bit 248 is shown with cooperating coring shoe 246 as illustrated in the aforementioned U.S. Pat. No. 4,981,183. Core bit 248 can be a variety of shapes, but preferably has a generally parabolic profile as indicated generally at 251. Alternatively, other profiles can be utilized to advantage. As an example, generally flat sides giving the bit a generally conical form may be utilized. Body member 256 of core bit 248 includes a plurality of passageways 252 which provides fluid communication between annulus 100 within core barrel 10 and discharge apertures 240 in the face of core bit 248. A plurality of cutters 26, preferably PDC cutters, is preferably distributed along the profile of core bit 248.

Body member 256 preferably includes a lower bore 257. At least one inner gage cutter 226, and preferably two or three such cutters 226 circumferentially spaced, extend inwardly of the surface defining lower bore 257 of core bit 248 to cut an inside gage, i.e., the external diameter of a core 28. Each individual gage cutter 226 is preferably formed with a flat 264 at this gage dimension, which is smaller than bore 257. Thus, annular lip or pilot section 262 of coring shoe 246 may extend downwardly to a position so that its tip 266 is immediately adjacent the upper edge 268 of cutters 226 within the annular space provided by cutters 226 between the different diameters defined by flats 264 and lower bore 257. Core bit 248 includes a shelf 258 on its inner surface above lower bore 257, which is contacted by bearing surface 260 and thereby forms a restriction, and ideally substantially a fluid seal, between the rotating bit and the stationary core barrel. With the foregoing arrangement, the core exterior is precisely cut and the core 28 enters the coring shoe 246 immediately upon leaving the upper edges of cutter flats 264. The preferred profile 251 in combination with the orientation and location of the exits of passageways 252 away from the inner gage of the core bit 248 promote improved flushing of formation cuttings as well as minimize exposure of the core to drilling fluid, thus enhancing both the mechanical and chemical integrity of the core sample. It will be evident to one of ordinary skill in the art that the arrangement of FIG. 2 may be modified to a low-invasion structure by differently configuring the inner gage of core bit 24 and using an extended shoe with a pilot portion, both as shown in FIG. 5 Inner housing 64 of bit end rotational bearing assembly 36 may be configured with passages located and oriented to direct fluid to passageways directing fluid to the bit face, rather than the throat or inner gage. Of course, channels 204 on the inner gage, as shown in FIG. 4, would be eliminated.

Figure 6B:
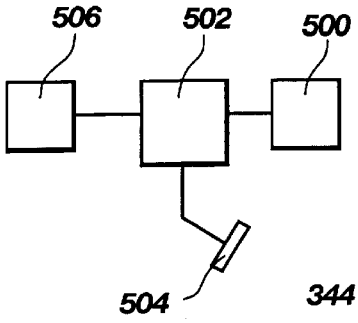
FIG. 6B is a schematic of surface instrumentation in combination with a receiver and a computer.
Figure 6A:
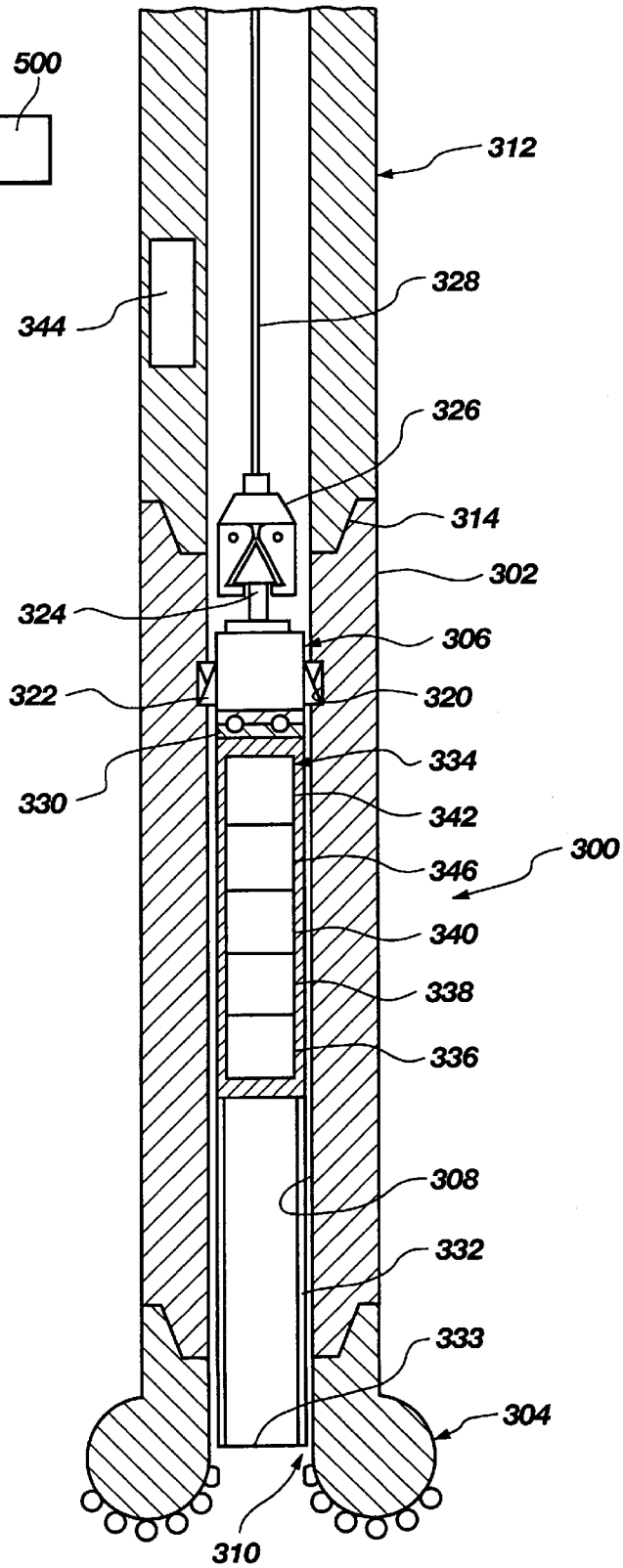
FIG. 6A is a schematic of a first preferred embodiment of a coring apparatus with an inner tube assembly in place in an arrangement suitable for concurrent coring and logging of borehole parameters and transmitting acquired borehole parameter data to the surface of the earth.

FIG. 6A of the drawings illustrates a first preferred coring apparatus embodiment 300 having the capability to obtain various data relating to various borehole parameters ("borehole data") during a coring operation. Apparatus 300 includes a core barrel 302 having a core bit 304 attached to the lower end thereof and an inner tube assembly 306 disposed in the longitudinal bore 308 of the core barrel 302 in alignment with the throat 310 of the core bit. As noted and described above, it is preferable that core bit 304 comprise a PDC core bit, and most preferably a stabilized core bit. Coring apparatus 300 is suspended in a borehole from a drill collar 312 by a typical API threaded connection 314.

Core barrel 302 includes a latch coupling 320 on the upper interior thereof, with which latch assembly 322 of inner tube assembly may be releasably engaged to retrieve inner tube assembly 306 via an overshot coupling 324 or other structure such as a fishing neck to be gripped by a retrieval mechanism such as overshot 326 at the end of a wireline 328. The major portion of inner tube assembly 306 is rotatably suspended from the upper, latched portion by a rotational bearing assembly 330 as known in the art. If desired, a bit end bearing assembly (not shown) as previously described herein may also be employed to stabilize the lower end of the inner tube assembly 306. Bearing assembly 330 and an the optional bit end bearing assembly permit rotation of core barrel 302 about inner tube assembly 306 below bearing assembly 330 to cut a core of formation material without rotationally-induced stress thereon, a technique well known in the art.

Coring tube 332 with open mouth 333 at its lower end is positioned to receive a formation core passing through core bit throat 310. An instrument and data transmission module 334 is located above coring tube 332 and below bearing assembly 330, module 334 including a pressure housing within which electronic instrumentation for obtaining borehole data and at least part of the data transmission device may be contained.

By way of example only, module 334 may include instrumentation 336 to determine borehole position and orientation (azimuth, slope, etc.), such being hereinafter referred to generally as "directional instrumentation," as well as instrumentation 338 to obtain data relating to formation characteristics, such as (by way of example only) borehole temperature, borehole pressure, formation resistivity, formation gamma ray emissions, formation nuclear magnetic resonance, density and porosity, such being hereinafter referred to as "formation evaluation instrumentation". The aforementioned instrumentation is typically provided with at least some processing capability as well as electronic machine-readable memory, both referenced at 340, for storage of obtained data, and is in communication with data transmission device 342 for transmitting real-time data to the surface of the earth.

In apparatus 300, data transmission device 342 may comprise a mud-pulse telemetry unit, an acoustic telemetry unit, or may even comprise a short-hop wireless transmitter to transmit data to another long-distance transmitter 344 above coring apparatus 300 for re-transmission to the surface of the earth, long-distance transmitter capabilities including mud-pulse, acoustic and electromagnetic telemetry. Finally, data transmission device 342 may comprise a transmitter for sending data to the surface of the earth via a wireline 328 through a wet connection, or other physical or electromagnetic connection as known in the art.

It is obviously necessary that some sort of power supply 346 be located in inner tube assembly to power the borehole data instrumentation and data transmission device, and such may be provided by batteries (optionally of the rechargeable type) as well as a mud turbine, or a combination thereof, as known in the art. Alternatively, power may be supplied through wireline 328, but such an arrangement is less preferred as requiring the continued presence of wireline 328 in the drill string during coring.

It will be appreciated by those of ordinary skill in the art that the directional instrumentation, as well as being used to track the course of the borehole, may (and is desirably) also used to develop and maintain a record of the orientation of the core as it is being cut, so as to correlate the core data with the borehole data obtained from the formation surrounding coring apparatus 300 and from which the core sample is cut.

Figure 7:
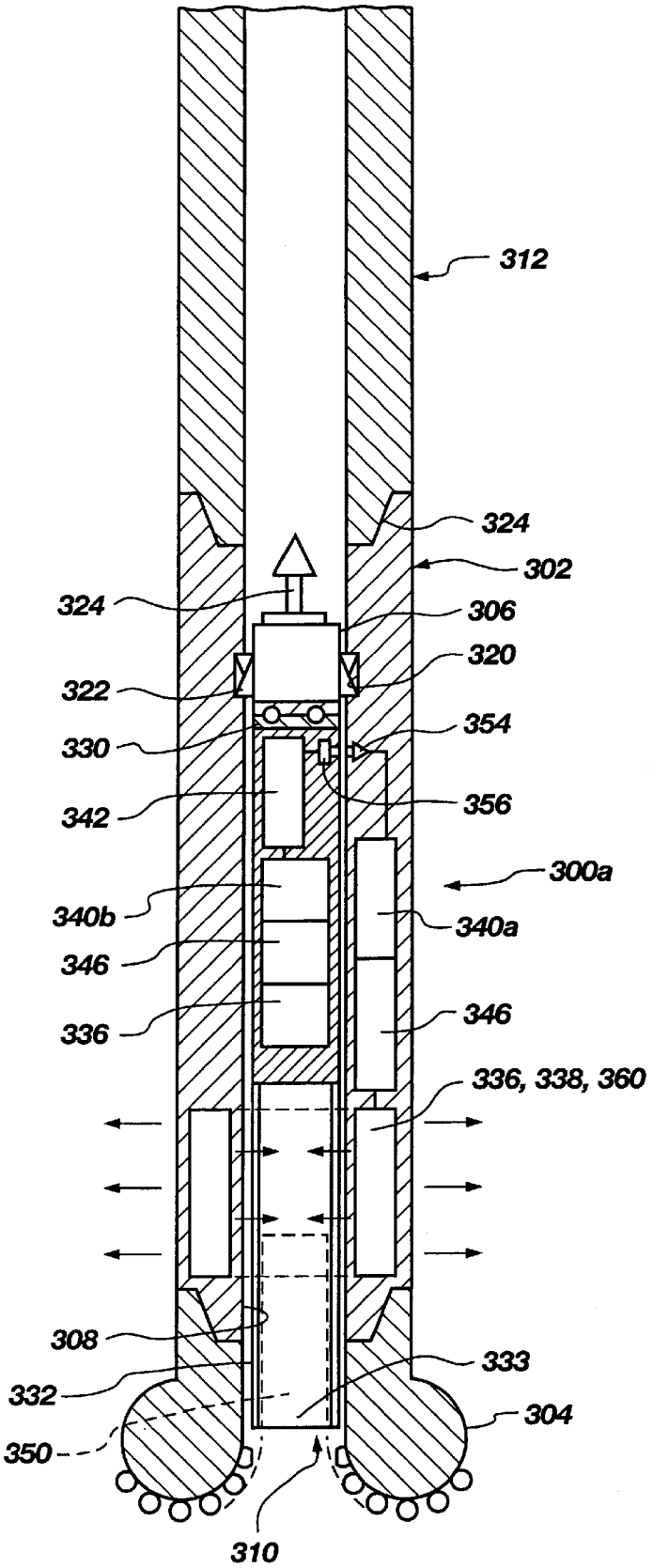
FIG. 7 is a schematic of a second preferred embodiment of a coring apparatus with an inner tube assembly in place in an arrangement suitable for concurrent coring and logging of borehole parameters and transmitting acquired borehole parameter data to the surface of the earth.

FIG. 7 illustrates a second preferred coring apparatus embodiment 300*a*, wherein components and features previously-described with respect to FIG. 6A are identified with the same reference numerals. As such, only significant differences between the two coring assemblies will be noted in describing apparatus 300*a*. In apparatus 300*a*, the formation evaluation instrumentation 338 is housed in the wall of core barrel 302, and may comprise a series of pressure housings disposed circumferentially about barrel 302, or a continuous, toroidal-shaped pressure housing. As shown by the arrows directed inwardly and outwardly of instrumentation 338, such an arrangement facilitates the concurrent taking of formation evaluation data from the surrounding formation and from a core 350 as it enters mouth 333 of coring tube 332 and travels relatively upwardly therein (due to the forward or downward movement of the coring assembly). Any or all of the previously-mentioned types of formation evaluation instrumentation may be employed, it being understood that gamma ray emission, porosity, density, resistivity, nuclear magnetic resonance and sonic logs are believed to be especially suitable to conduct with respect to the characteristics of core 350. Core barrel 302 and the wall and exterior thereof may be configured accordingly for "transparency" to the relevant incoming and (in some cases) outgoing fields, waves, subatomic particles and other signals employed in taking such logs. It will be appreciated that the various locations depicted and described for sensors to measure various borehole parameters may be varied depending on the logical location for each to best obtain data, and so assemblies will vary accordingly.

As previously noted, it is also highly desirable, and most would say critical, to ascertain the orientation of the core (azimuth, angle with respect to the vertical) both in an absolute sense and also for correlation with the surrounding formation being logged. Other variations of apparatus 300*a* from apparatus 300 include the disposition of processor(s) and electronic memory 340*a* as well as a power supply 346 in core barrel 302, and the use of a wireless telemetry transmitter 354 to transmit data to receiver 356 located in inner tube assembly 306 for re-transmission to the surface via data transmission or telemetry device 342, which may comprise a mud pulser or any other previously-mentioned type of system. Further, inner tube assembly 306 houses another power supply 346 to power not only data transmission device 342 but also additional processors and memory 340*b* and directional instrumentation 336. Thus, both formation and directional data may be sent to the surface in real time, and either or both as desired may be stored in memory 340*b* for periodic retrieval with inner tube assembly 306 for downloading at the surface. It is also contemplated that the location of formation evaluation instrumentation 338 immediately adjacent core bit 304 also provides an extremely beneficial location for drilling parameter instrumentation 360 to monitor such characteristics as torque, rotational speed, weight on bit, vibration and pressure, as well as directional parameters as previously referenced, the latter being beneficial for overall tracking of the borehole path as well as to pinpoint the location and orientation of potential zones or strata of interest. As shown, directional instrumentation 336 may be optionally housed in core barrel 302 instead of being carried by inner tube assembly 306.

Figure 8:
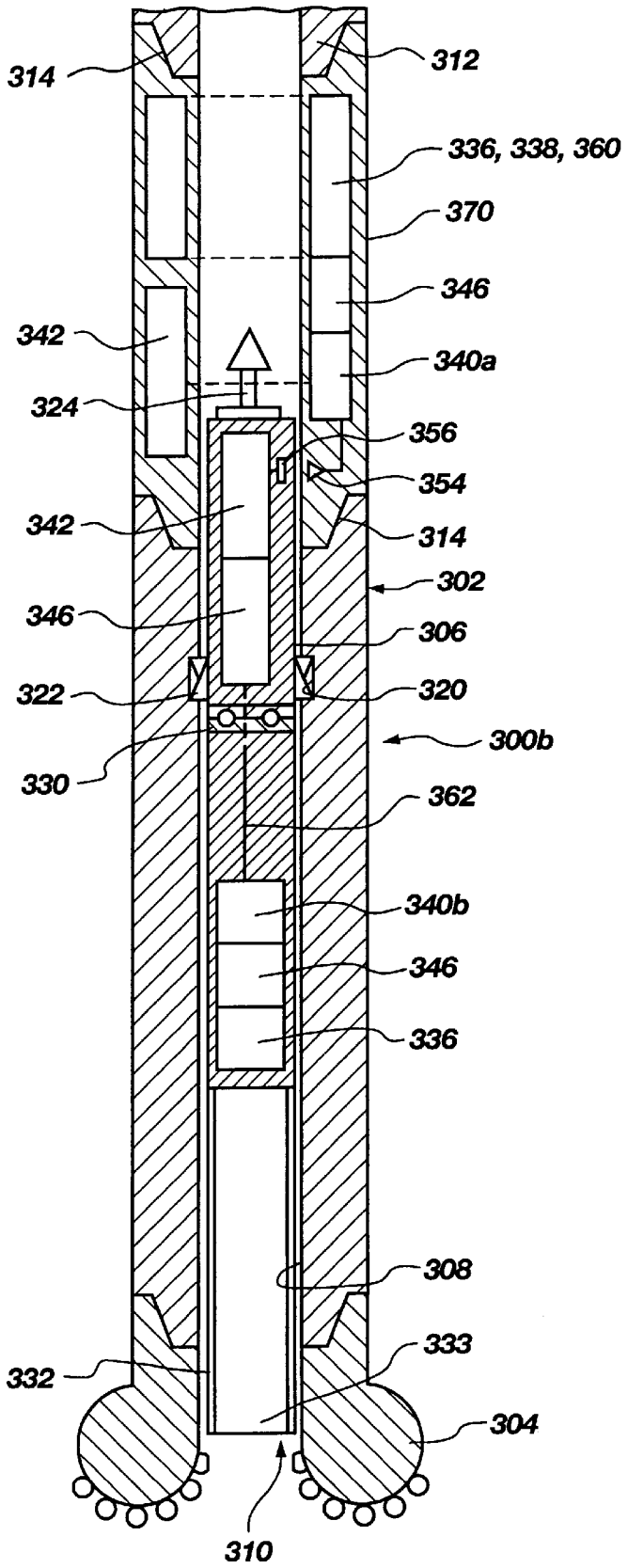
FIG. 8 is a schematic of a third preferred embodiment of a coring apparatus with an inner tube assembly in place in an arrangement suitable for concurrent coring and logging of borehole parameters and transmitting acquired borehole parameter data to the surface of the earth.

FIG. 8 depicts a third preferred embodiment 300*b* of a coring apparatus according to the present invention. As with embodiment 300*a*, features and components previously described will be identified with like reference numerals, and only differences between apparatus 300*b* and those previously described will be dealt with in detail. As shown, apparatus 300*b* includes an instrumentation sub 370 above core barrel 302 providing one or more of directional instrumentation 336, formation evaluation instrumentation 338, and drilling parameter instrumentation 360. Sub 370 may comprise a modified reservoir navigation tool, or RNT, available from the INTEQ operating unit of Baker Hughes, assignee of the present invention. Sub 370 includes a power supply 346 as well as data processing and memory electronics 340*a*. Data from sub 370 is transmitted via short-hop transmitter-receiver combination 354 and 356 to data transmission unit 342 in inner tube assembly 306, which also contains a power supply 346 and preferably at least memory 340*b* if processing capability is not otherwise required in the retrievable assembly. Further, and as shown, the directional instrumentation 336 may be included in inner tube assembly 306 rather than in sub 370, and an additional power supply 346 included to power the directional instrumentation 336. Communication link 362, extending from directional instrumentation 336 and memory 340*b* may comprise a hard-wired link employing a slip-ring coupling to traverse bearing assembly 330, or a wireless electromagnetic short-hop link, as desired. A further option is to employ a telemetry unit 342 in sub 370 and transmit to the surface therefrom data from instrumentation in the inner tube assembly 306 being short-hopped to sub 370 in an arrangement the reverse of that shown.

Figure 9:
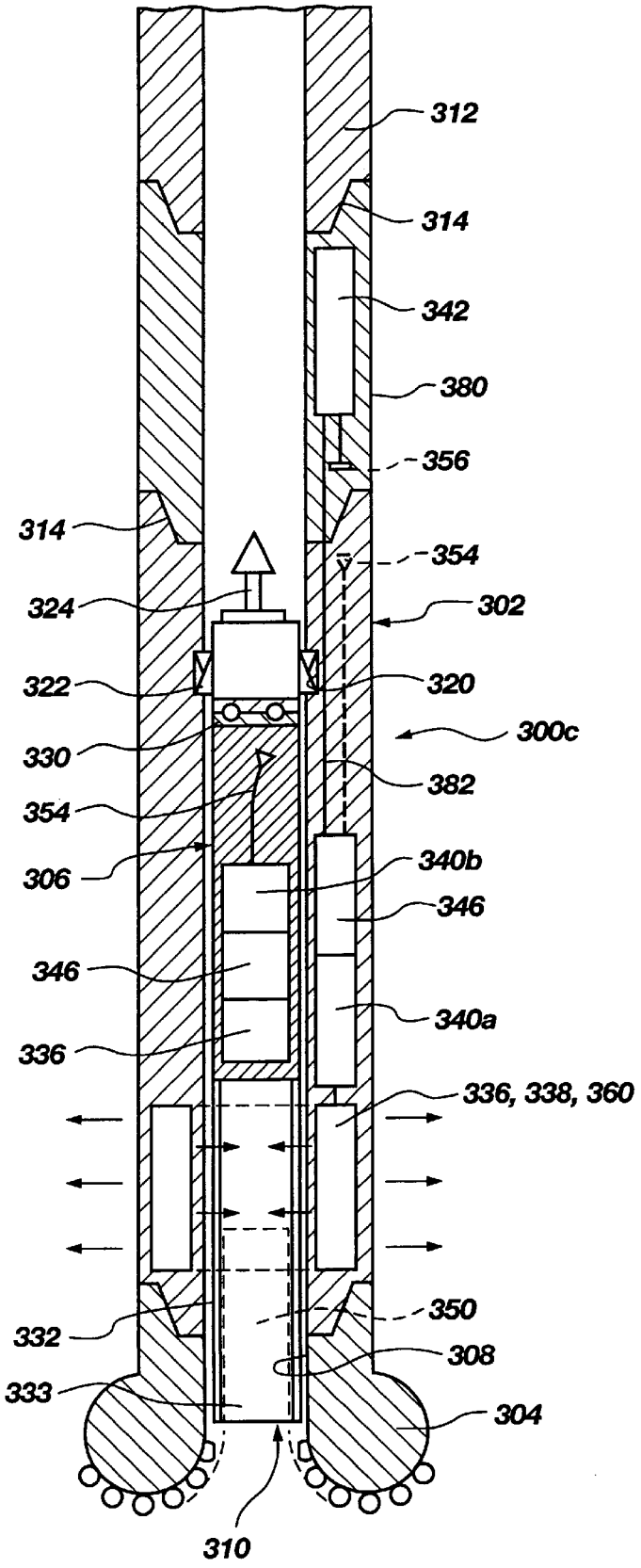
FIG. 9 is a schematic of a fourth preferred embodiment of a coring apparatus with an inner tube assembly in place in an arrangement suitable for concurrent coring and logging of borehole parameters and transmitting acquired borehole parameter data to the surface of the earth.

FIG. 9 depicts yet a fourth preferred embodiment 300*c* of the coring apparatus of the present invention. As with previous figures, features and elements will be identified where possible with reference numerals already employed, and only significant differences in the apparatus of FIG. 9 will be described in any detail. Apparatus 300*c* employs a telemetry sub 380 located above core barrel 302, sub 380 preferably housing an acoustic or electromagnetic telemetry or data transmission device 342. Formation evaluation instrumentation 338 and drilling parameter instrumentation 360 are housed in core barrel 302 and, as with the embodiment of FIG. 7, the formation evaluation instrumentation may have the capability to do a "look-in" log of a core sample 350 as it travels into coring tube 332. A hard-wired telemetry link 382 may be used to transmit data from core barrel-carried instrumentation to telemetry sub 380 via couplings between barrel 302 and sub 380 as known in the art, or a short-hop wireless arrangement may be employed. Similarly, the direction instrumentation 336 (optionally housed in either inner tube assembly 306 or core barrel 302) may short-hop transmit to telemetry sub 380, such an arrangement being preferable to a hard-wired link between the inner tube assembly 306 and the core barrel 302 or telemetry sub 380.

It will be appreciated, as previously described with respect to FIG. 3, that a center plug for drilling the full borehole diameter may be substituted for inner tube assembly 306 until the interval to be cored is reached. Further, such a center plug including a data transmission device, electronic memory and a short-hop receiver may be employed to transmit data to the surface from formation evaluation instrumentation 338, drilling parameter instrumentation 360, or even directional instrumentation 336 contained in core barrel 302 as previously depicted in the embodiments of FIGS. 6 through 9. Thus, by real-time evaluation of formation characteristics while drilling the borehole, a suitable location for commencement of coring at a potential zone or stratum of interest may be identified virtually immediately and with relatively high precision in comparison to prior art techniques. At such point, the center plug would be retrieved and an inner tube assembly 306 inserted in core barrel 302 in its place. In a similar manner, and with the appropriate formation evaluation instrumentation in place during the coring operation, a relatively precise end or termination of the interval or zone of interest may be determined. At such point, coring may be ceased, the last core retrieved and a center plug re-inserted into the core barrel to drill ahead without coring. In such a manner, a plurality of zones of interest may be located and drilled while coring, while the intervals between zones of interest are merely logged and drilled without cores being taken.

Figure 10:
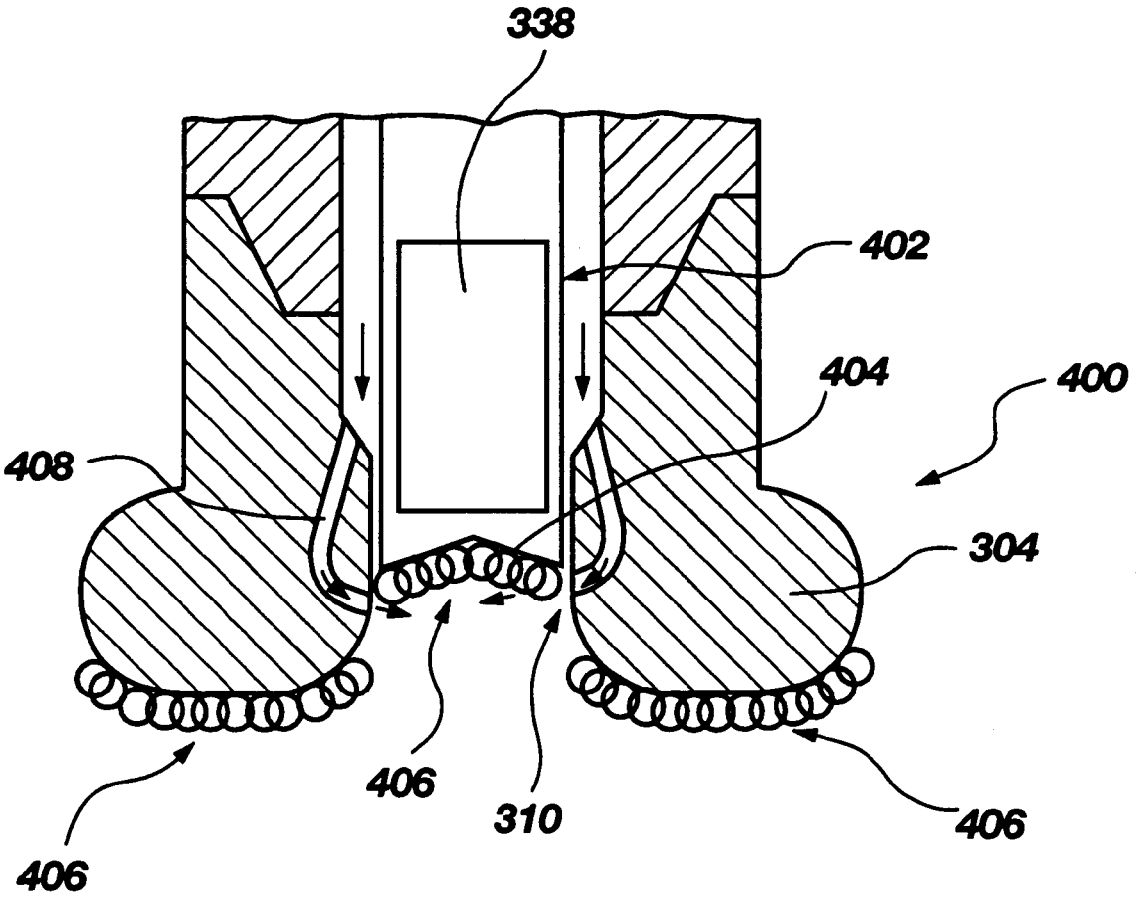
FIG. 10 is a schematic of the lower end of a preferred, instrumented center plug assembly according to the invention.

As shown in FIG. 10, it may be desirable to configure the coring apparatus of the invention in an embodiment 400, shown here with a center plug 402 in place, such that formation evaluation instrumentation 338 is disposed within the actual throat 310 of the core bit 304 itself and immediately adjacent the leading face 404 of the plug 402 wherein cutters 406 are located. Such sensor proximity to the formation ahead of the coring apparatus may require a reconfiguration of the internal fluid passages 408 of core bit 304 as shown, since it might no longer be possible (compare to center plug 80 and passage 86 of FIG. 3) to route such passages through the end of the center plug. Passages 408 would be operative only with a center plug 402 being blocked off by appropriate configuration of an inner tube assembly so as to avoid contamination of the core. Of course, as previously noted, directional and/or drilling parameter instrumentation may also be included in a center plug such as 80 or 402.

While short-hop and long-distance telemetry systems have been described above in terms of a single transmitter and receiver for simplicity, it will be readily understood that two-way transmission may be desirable in many instances, such as to activate or de-activate instrumentation, to change instrumentation to a different mode of operation, or to query instrumentation for calibration or test purposes.

Further, while the instrumentation previously described herein has all been disposed in the borehole as part of the coring apparatus of the invention, it will be understood and appreciated by those of ordinary skill in the art that surface instrumentation on or below the rig floor may be employed to monitor drilling-related parameters which may be correlated and used in combination with the data received from the downhole instrumentation. Thus, surface instrumentation 500 as depicted in FIG. 6B may be used in combination with computer 502 and with data received from downhole through receiver 504 to provide data to the operator through display 506, which may comprise a digital or graphic display in transient form (such as on a video display) or permanent form (paper, film, electronic memory including magnetic or optical, etc.) and re-transmitted if desired via land-lines, radiotelemetry or satellite link to another site for further evaluation.

As wirelines, overshots, overshot couplings, latch couplings and latch assemblies, core catchers, bearing assemblies and other core barrel components of a wide variety of designs are well-known in the art, these elements have not been described in detail. Similarly, various bypass valve assemblies of various designs might be employed with core barrels of the invention to alternately direct drilling fluid flow through or around inner tube assemblies and to permit displacement of fluid by the core, but such devices are entirely conventional as well, familiar to those of ordinary skill in the art, and so will not be illustrated or described. Finally, the various types of directional, drilling and formation parameter instrumentation referenced herein being known in the art, as well as associated data transmission and other electronics (processors, memory, power supplies, etc.) no detailed description thereof is required.

While the invention has been described in terms of certain preferred embodiments, it is not so limited, and many additions, deletions and modifications to the embodiment illustrated and described herein may be made without departing from the scope of the invention as hereinafter claimed.

What is claimed is:

1. A subterranean formation boring apparatus, comprising:

a tubular barrel including structure at an upper end thereof for connection to a boring string, and defining a longitudinal bore;

a core bit disposed at a lower end of the tubular barrel; and formation evaluation instrumentation operable to obtain data relating to at least one formation characteristic parameter concurrently with cutting of a core from a formation, at least a portion of which formation evaluation instrumentation is located within the barrel between an exterior thereof and the bore, wherein the formation evaluation instrumentation includes at least one sensing device for detecting a formation characteristic parameter selected from the group comprising: formation gamma ray emissions, formation resistivity, formation porosity, formation density, nuclear magnetic resonance, pressure, and temperature.

2. The apparatus of claim 1, wherein at least a portion of the formation evaluation instrumentation is located proximate the core bit.

3. The apparatus of claim 1, wherein the formation evaluation instrumentation portion located between the exterior and the bore of the barrel is adapted and positioned to obtain data relating to at least one formation characteristic parameter from a core segment located in the longitudinal barrel bore laterally adjacent said instrumentation.

4. The apparatus of claim 1, further including a retrievable inner tube assembly configured for placement within the barrel bore and including a lower portion structured to receive a core cut by the core bit.

5. The apparatus of claim 4, further including a transmitter for sending data to a location remote from the borehole data instrumentation.

6. The apparatus of claim 5, wherein the transmitter is located above the lower portion of the inner tube assembly.

7. The apparatus of claim 6, wherein the transmitter is a part of the inner tube assembly.

8. The apparatus of claim 5, wherein the transmitter is selected from the group comprising a mud pulser, an acoustic transmitter, and an electromagnetic transmitter.

9. The apparatus of claim 1, further including directional instrumentation operable to obtain data relating to position and orientation of the apparatus.

10. The apparatus of claim 4, further including directional instrumentation operable to obtain data relating to position and orientation of the apparatus, and wherein the directional instrumentation and the lower portion of the inner tube assembly are cooperatively configured to provide orientation data for the received core.

11. The apparatus of claim 1, further including machine-readable memory for storing borehole data in the apparatus.

12. The apparatus of claim 1, further including a transmitter for sending data to a location remote from the borehole data instrumentation.

13. The apparatus of claim 12, further including a subterranean receiver positioned above the barrel for receiving data transmitted by the transmitter, and a second transmitter associated with the receiver for re-transmitting data to the surface of the earth.

14. The apparatus of claim 12, wherein the transmitter is selected from the group comprising a mud pulser, an acoustic transmitter, and an electromagnetic transmitter.

15. The apparatus of claim 1, further including instrumentation at the surface of the earth for obtaining drilling parameter data, a transmitter proximate the barrel for sending data from the formation evaluation instrumentation to the surface of the earth, a receiver at the surface of the earth for receiving data from the transmitter, and a computer for processing the received data and data from the surface instrumentation.

16. The apparatus of claim 12, wherein the transmitter is located above the barrel.

17. The apparatus of claim 1, further including drilling parameter instrumentation operable to obtain information data relating to at least one parameter selected from the group comprising torque, rotational speed, weight on bit, vibration, and pressure.

18. The apparatus of claim 9, further including drilling parameter instrumentation operable to obtain information data relating to at least one parameter selected from the group comprising torque, rotational speed, weight on bit, vibration, and pressure.

19. The apparatus of claim 15, further including directional instrumentation located proximate the barrel and operable to obtain data relating to position and orientation of the apparatus for transmission to the surface of the earth by the transmitter.

20. The apparatus of claim 1, wherein the at least a portion of the formation evaluation instrument located within the barrel is located immediately proximate the core bit.

21. A subterranean formation boring apparatus, comprising:

a tubular barrel including structure at an upper end thereof for connection to a boring string, and defining a longitudinal bore;

a core bit disposed at a lower end of the tubular barrel; and formation evaluation instrumentation operable to obtain data relating to at least one formation characteristic parameter concurrently with cutting of a core from a formation, at least a portion of which formation evaluation instrumentation is located within the barrel between an exterior thereof and the bore, wherein the formation evaluation instrumentation is adapted to substantially concurrently obtain data relating to at least one formation characteristic parameter from a core segment and data relating to at least one formation characteristic parameter from a formation exterior to the barrel.

22. The apparatus of claim 2, wherein the at least one core segment formation characteristic parameter and the at least one exterior formation characteristic parameter are the same.

23. The apparatus of claim 21, wherein the formation evaluation instrumentation includes at least one sensing device for detecting a formation characteristic parameter selected from the group comprising: formation gamma ray emissions, formation resistivity, formation porosity, formation density, nuclear magnetic resonance, pressure, and temperature.

24. A method of boring a subterranean formation, comprising:

drilling, without coring, a first borehole interval into said subterranean formation with a boring string while concurrently obtaining borehole data;

without removing said boring string from the borehole, coring a second borehole interval extending from a termination point of said first borehole interval while concurrently obtaining borehole data.

25. The method of claim 24, wherein obtaining borehole data comprises obtaining formation characteristic parameter data.

26. A method of boring a subterranean formation, comprising:

drilling a borehole interval into said subterranean formation while simultaneously cutting a formation core sample along a longitudinal axis of the drilled borehole interval from a leading end thereof; and concurrently with said drilling and said cutting, sensing at least one borehole formation characteristic parameter from a location immediately proximate a location wherein the core sample is severed from the formation.

27. The method of claim 26, further including, concurrently with said drilling and said cutting, sensing at least one drilling parameter from a location immediately proximate a location wherein the core sample is severed from the formation.

28. The method of claim 26, further including, concurrently with said drilling and said cutting, sensing at least one directional parameter from a location immediately proximate a location wherein the core sample is severed from the formation.

29. A subterranean formation boring apparatus, comprising:

a tubular barrel including structure at an upper end thereof for connection to a boring string, and defining a longitudinal bore;

a core bit disposed at a lower end of the tubular barrel;

formation evaluation instrumentation operable to obtain data relating to at least one formation characteristic parameter concurrently with cutting of a core from a formation, at least a portion of which formation evaluation instrumentation is located within the barrel between an exterior thereof and the bore;

instrumentation at the surface of the earth for obtaining drilling parameter data;

a transmitter proximate the barrel for sending data from the formation evaluation instrumentation to the surface of the earth;

a receiver at the surface of the earth for receiving data from the transmitter;

a computer for processing the received data and data from the surface instrumentation; and directional instrumentation operable to obtain data relating to position and orientation of the apparatus for transmission to the surface of the earth by the transmitter, wherein the directional instrumentation is located in the barrel between the exterior and the bore thereof.

30. The apparatus of claim 29, wherein the directional instrumentation is located immediately proximate the formation evaluation instrumentation.

31. The apparatus of claim 30, wherein the formation evaluation instrumentation and the directional instrumentation are located immediately proximate the core bit.

* * * * *

UNITED STATES PATENT AND TRADEMARK OFFICE

CERTIFICATE OF CORRECTION

PATENT NO. : 6,006,844
DATED : December 28, 1999
INVENTOR(S) : Van Puymbroeck et al.

It is certified that error appears in the above-identified patent and that said Letters Patent is hereby corrected as shown below:

Drawings,
Fig. 7, change reference numeral "324" on right side, to -- 314 --.

Column 2,
Line 62, change "punch-and" to -- punch– and --;
Line 65, after "wells" insert -- , --;

Column 3,
Line 34, after "extended-length" insert -- , --;
Line 53, change "thirty foot" to -- thirty-foot --;

Column 6,
Line 60, change "bearing" to bearings --;
Line 65, after "core 28" insert -- (FIG 2) --;

Column 7,
Line 8, after "FIG. 1" insert -- , --;
Line 15, after "shown)" insert -- , --;
Line 22, after "end" insert -- rotational --;

Column 8,
Line 6, change "Pressure" to -- pressure --;

Column 9,
Line 1, after "bore" insert -- lower --;
Line 50, after "end" insert -- rotational --;

Column 11,
Line 7, after "vertical)" insert --, --;

Column 12,
Line 17, after "between" insert -- core --;
Line 19, change "direction" to -- directional --;
Line 57, after "of the" insert -- center --; and Column 13,
Line 41, after "etc.)" insert --, --.

Column 14, claim 5,
Line 15, change "borehole data" to -- formation evaluation --;

UNITED STATES PATENT AND TRADEMARK OFFICE

CERTIFICATE OF CORRECTION

PATENT NO. : 6,006,844,
DATED : December 28, 1999
INVENTOR(S) : Van Puymbroeck et al.

It is certified that error appears in the above-identified patent and that said Letters Patent is hereby corrected as shown below:

Column 14, claim 12,
Line 37, change "borehole data" to -- formation evaluation --;

Column 15, claim 20,
Line 5, change "instrument" to instrumentation --;

Column 15, claim 22,
Line 25, change "claim 2," to claim 21, --;

Column 15, claim 24,
Line 39, after "data;" insert -- and --;

Column 16, claim 27,
Line 9, change "the" to -- a --; and

Column 16, claim 28,
Line 15, change "a" to -- the --.

Signed and Sealed this

Fifth Day of February, 2002

*Attest:*

*Attesting Officer*

JAMES E. ROGAN
*Director of the United States Patent and Trademark Office*